US005405575A

United States Patent [19]

Yazawa et al.

[11] Patent Number: 5,405,575

[45] Date of Patent: Apr. 11, 1995

[54] HIGH CR CONTENT, P ADDED FERRITIC STAINLESS STEEL HAVING IMPROVED ATMOSPHERIC CORROSION RESISTANCE AND RUST PREVENTION

[75] Inventors: Yoshihiro Yazawa; Yasushi Kato; Fusao Togashi; Keiichi Yoshioka; Sadao Hasuno, all of Chiba, Japan

[73] Assignee: Kawasaki Steel Corporation, Japan

[21] Appl. No.: 140,005

[22] PCT Filed: Feb. 25, 1993

[86] PCT No.: PCT/JP93/00231

§ 371 Date: Oct. 22, 1993

§ 102(e) Date: Oct. 22, 1993

[87] PCT Pub. No.: WO93/17143

PCT Pub. Date: Sep. 2, 1993

[30] Foreign Application Priority Data

| | | | |
|---|---|---|---|
| Feb. 25, 1992 | [JP] | Japan | 4-037726 |
| Oct. 2, 1992 | [JP] | Japan | 4-265033 |
| Oct. 6, 1992 | [JP] | Japan | 4-267592 |

[51] Int. Cl.[6] ..... C22C 38/18

[52] U.S. Cl. ..... 420/42

[58] Field of Search ..... 420/42

[56] References Cited

U.S. PATENT DOCUMENTS

| | | | |
|---|---|---|---|
| 3,834,878 | 9/1974 | Vansteenkiste | 420/42 |
| 4,824,635 | 4/1989 | Hoshino et al. | 420/42 |

FOREIGN PATENT DOCUMENTS

| | | | |
|---|---|---|---|
| 0429793A1 | 6/1991 | European Pat. Off. . | |
| 746957 | 7/1933 | France . | |
| 2063666 | 5/1972 | Germany . | |
| 298680 | 5/1971 | U.S.S.R. | 420/42 |

*Primary Examiner*—Deborah Yee

*Attorney, Agent, or Firm*—Austin R. Miller

[57] ABSTRACT

High Cr content, P added ferritic stainless steel containing, in % by weight, C: up to 0.02%, Si: up to 1.0%, Mn: up to 1.0%, S: up to 0.03%, Cr: from more than 20% to 40%, N: up to 0.015%, Al: up to 0.5%, and P: from more than 0.06% to 0.20%, the balance being Fe and incidental impurities, is improved in atmospheric corrosion resistance and rust prevention. The stainless steel may further contain at least one element selected from the following groups: (1) Mo: up to 4.0%; (2) one or more elements of Ti: up to 1.0%, Nb: up to 1.0%, Ta: up to 1.0%, V: up to 1.0%, W: up to 1.0%, Zr: up to 1.0%, and B: up to 0.01%; and (3) one or more elements of Cu: up to 1.0%, Ni: up to 5.0%, and Co: up to 1.0%.

17 Claims, 7 Drawing Sheets

Rating
A: no rusting
B: a low degree of rusting
C: a medium degree of rusting
D: a high degree of rusting

HIGH CR CONTENT, P ADDED FERRITIC STAINLESS STEEL HAVING IMPROVED ATMOSPHERIC CORROSION RESISTANCE AND RUST PREVENTION

TECHNICAL FIELD

This invention relates to high Cr content, P added ferritic stainless steel having improved atmospheric corrosion resistance, rust prevention, and weld properties. The inventive steel finds a wide range of application as ferritic stainless steel to be used under conditions where atmospheric corrosion resistance and rust prevention are required, such as building exterior materials and certain structures.

BACKGROUND ART

Most of conventional stainless steel strips used as building exterior materials where atmospheric corrosion resistance is required are of relatively small areas as typified by panels, sashes and curtain walls.

However, the demand for stainless steel as large sized building exterior materials as typified by roofing members is expanding in the recent years because of the appreciated design, aesthetic appearance, corrosion resistance and weathering features inherent to stainless steel, combined with the development of its application technique. In this regard, painted stainless steel strips based on stainless steel strips coated with paint for coloring are mainly used as roofing members, for example. This is intended to overcome the drawback of conventional zinc coated steel roofing members which yield painting defects due to deterioration of the paint coating and eventually become unusable. For the painted stainless steel strips, SUS 304 (18Cr-8Ni), which is an austenitic stainless steel, has been employed from the standpoint of its workability. However, because of the paint coating on the surface, the painted stainless steel strips cannot take advantage of the design feature offered by the metallic luster of silver white color inherent to stainless steel. Another consideration is the increased cost of austenitic stainless steel which contains more of expensive nickel.

In addition, austenitic stainless steel is not suitable as a length of steel since its coefficient of thermal expansion is about 1.5 to 2 times that of ferritic stainless steel. Ferritic stainless steel thus seems more attractive as building exterior materials although it is inevitably required to have the satisfactory outdoor atmospheric corrosion resistance and rust prevention ability that red rust and corrosion such as pitting corrosion caused by deposition of sea-salt fine particles do not occur over a long term, when used as building exterior materials, especially as roofing members without painting. For this and other reasons, targeting the high atmospheric corrosion resistance, high rust prevention ferritic stainless steel, attempts have been made to enhance corrosion resistance by reducing C and N contents, increasing Cr content and increasing the amount of Mo added, as typified by Japanese Patent Application Kokai No. 138058/1980. However, simply increasing the Cr content and the amount of Mo added results in a high alloy having an increased cost and hence a limit from an economical aspect, and there arise problems from a loss of shapability due to increased hardness and a loss of productivity due to decreased toughness. Thus there is a strong desire to develop a material which can be expected to be increased in atmospheric corrosion resistance and rust prevention by adding elements other than Cr and Mo and which is of lower cost.

On the other hand, in the event that steel is used in areas where it must be welded for a construction reason, conventional high Cr content steel and Mo-containing steel are insufficient in the toughness and rust prevention of welds.

DISCLOSURE OF THE INVENTION

The present invention whose object is to meet such requirements provides a ferritic stainless steel which is of lower cost than conventional steel and improved in atmospheric corrosion resistance and rust prevention by adding from more than 0.06% to 0.2% by weight of phosphorus to steel having a Cr content of more than 20% by weight. More specifically, an object of the present invention is to provide a ferritic stainless steel which can be improved in atmospheric corrosion resistance and rust prevention by positively adding phosphorus, which has heretofore been considered detrimental to steel, within a manufacturable region range.

To attain the above objects, the present invention provides a high Cr content, P added ferritic stainless steel having improved atmospheric corrosion resistance and rust prevention, containing, in % by weight, C: up to 0.02%,
Si: up to 1.0%,
Mn: up to 1.0%,
S: up to 0.03%,
Cr: from more than 20% to 40%,
N: up to 0.015%,
Al: up to 0.5%, and
P: from more than 0.06% to 0.20%, the balance being Fe and incidental impurities.

In addition to the above-specified steel components, the stainless steel of the invention may further contain at least one element selected from the following groups (1) to (3).

(1) Mo: up to 4.0%
(2) one or more elements of Ti: up to 1.0%, Nb: up to 1.0%, Ta: up to 1.0%, V: up to 1.0%, W: up to 1.0%, Zr: up to 1.0%, and B: up to 0.01%.
(3) one or more elements of Cu: up to 1.0%, Ni: up to 5.0%, and Co: up to 1.0%.

It is preferred that the respective elements as expressed in % by weight meet the following equation (I).

$$8\times(C+N)\leqq Ti+Nb+V+Zr+W+Ta+B\leqq 1 \quad \text{(I)}$$

THE BEST MODE FOR CARRYING OUT THE INVENTION

Figure 1:
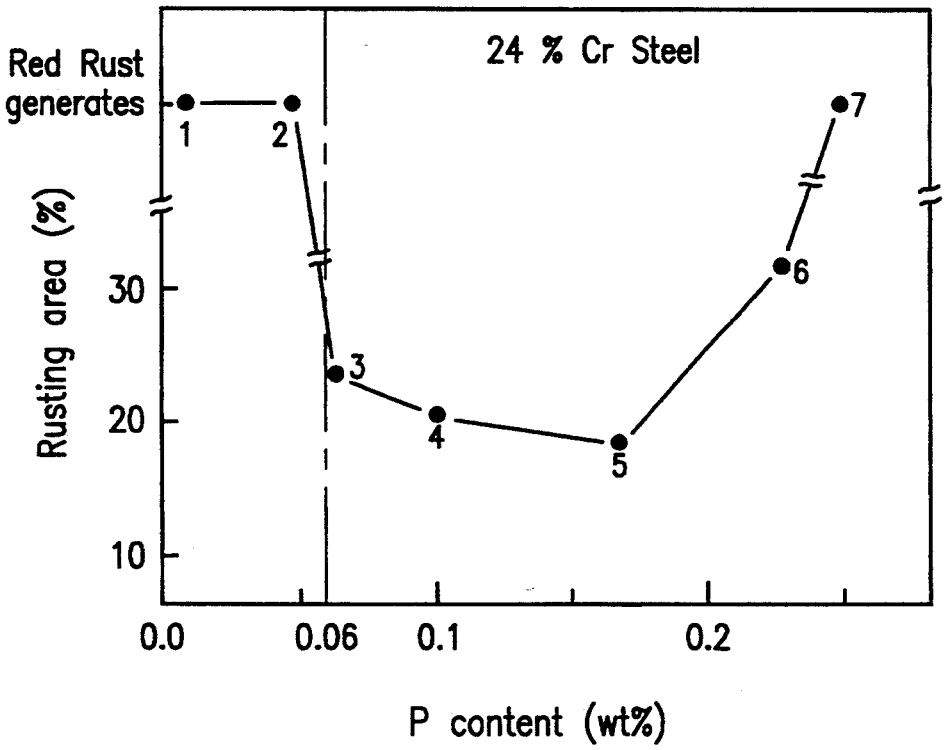
FIG. 1 is a diagram showing the influence on percent rusting area of P added to 24% Cr steel.

Below the present invention is described in further detail.

The ferritic stainless steel of the present invention is characterized by the positive addition of phosphorus, which was considered to be a deleterious element and called for efforts to reduce its content as low as possible, in an amount within the manufacturable range without detracting from shapability and workability. With respect to the influence of P on the corrosion resistance of stainless steel, it is described in "the Manual of Stainless Steel" that P in a complete solid solution state corresponding to its content of up to 0.1% gives little influence, but as the P content increases, pitting corrosion susceptibility increases and as a result, corrosion resistance lowers. Prior art attempts to reduce the P content as low as possible were made probably because of a loss of productivity due to a lowering of toughness by P as previously described. More particularly, in connection with productivity, it is generally known that P tends to segregate, enhances hot tearing, and promotes crack susceptibility at welds. For this reason, P was considered very deleterious to ferritic stainless steel which has a body-centered cubic structure and lower toughness than austenitic stainless steel, and investigations were made toward a maximum lowering of the P content. In fact, it is prescribed in JIS G-4304 or the like in conjunction with high Cr content ferritic stainless steels such as SUS 447J1 that their P content is up to 0.03%. In conjunction with other steel species, the P content is prescribed to be up to 0.04%.

Making a series of experiments to examine the influence on atmospheric corrosion resistance and rust prevention of P positively added to high Cr content stainless steel, the inventors have found that atmospheric corrosion resistance and rust prevention can be improved by positively adding P in excess of the range previously prescribed by JIS. The present invention is predicated on this novel finding.

Further making a series of experiments to examine the influence of P on the toughness and rust prevention of welds, quite unexpectedly, the inventors have found that if a proper amount of Ti, Nb, V, Zr, Ta, W or B is added, P is effective in improving not only the rust prevention of the matrix, but also the rust prevention of welds without lowering the toughness of welds.

From a standpoint of productivity on the other hand, the contents of C, Mn, Mo, Ni, Ti, Nb, Cu, N and Al are optimized.

Another merit derived from the addition of P is that the material is of low cost since the amounts of Cr and Mo known to be very effective for improving atmospheric corrosion resistance can be replaced by inexpensive P and that a substantial reduction in the raw material cost and the cost required for P removal is expected since the prior steps taken for lowering the P content are eliminated or saved. For these reasons, the inventive steel offers great benefits to the industry. In order that the steel exert such benefits, P is added in an amount of from more than 0.06% by weight to 0.2% by weight.

Described below is the reason of limiting the steel composition.

(C & N)

Carbon and nitrogen are elements having substantial influence on the workability, toughness, rust prevention and weld properties of ferritic stainless steel. In the inventive steel, the upper limit is 0.02% by weight for C and 0.015% by weight for N so as to avoid any loss of productivity due to toughness lowering and any loss of weld toughness. The lower limit is not determined since the effect of reducing these elements is not saturated and C and N contents as low as possible are preferred.

(Si)

Silicon is generally added as a deoxygenating agent and especially effective for improving oxidation resistance. It is also effective for improving atmospheric corrosion resistance and rust prevention, but when added in larger amounts, causes not only a lowering of toughness and workability of the matrix material through its own solid solution reinforcement, but also a lowering of the toughness of welds. Particularly at a Si content in excess of 1.0% by weight, there occurs a substantial lowering of the toughness of welds even when Ti, Nb, Zr, V, Ta, W, and B are added as will be described later. The upper limit is thus 1.0% by weight.

(Mn)

Manganese is generally added as a deoxygenating agent. Since it is an austenite stabilizing element, an excess amount of Mn added fails to provide a ferritic single phase structure because of formation of austenite at elevated temperatures and detracts from corrosion resistance. The upper limit is thus 1.0% by weight.

(S)

Sulfur is a corrosion resistance lowering element and lesser amounts are better. In excess of 0.03% by weight of S, a substantial loss of corrosion resistance occurs despite the execution of P addition according to the main feature of the invention. The upper limit is thus 0.03% by weight.

(Cr)

Chromium is an important element which governs the corrosion resistance essential to the inventive steel. In general, corrosion resistance improves as the Cr content increases. Addition of Cr in excess of 40% by weight results in a substantial lowering of toughness and a noticeable loss of productivity. With 20% by weight or less of Cr, generation of red rust in a salt-affected corrosive environment near the seashore cannot be fully inhibited and the steel strip intended herein is not available. The lower limit is thus more than 20% by weight.

(Al)

Aluminum is added as a deoxygenating agent. When Al is added in excess of 0.50% by weight, workability is lowered due to dispersion of inclusions. Slag spots are frequently formed during welding and properties are less preferable. The range of Al added is limited to 0.50% by weight or lower.

(P)

Phosphorus is a critical element in the present invention. It is an element effective for improving atmospheric corrosion resistance and rust prevention as well as rust prevention at welds. Since no definite effect is exerted unless it exceeds 0.06%, the lower limit of P is more than 0.06%. Inversely, if it is added in excess of 0.2%, then atmospheric corrosion resistance and rust prevention are rather lowered, toughness is lost, and manufacturing becomes difficult. The upper limit is thus 0.20%.

(Mo)

Molybdenum is an additive element for improving atmospheric corrosion resistance and rust prevention and is effective in proportion to the addition amount. In excess of 4.0% by weight, its effect is substantially saturated, the material becomes uneconomical, and the toughness of the matrix material and the toughness at welds are considerably reduced. The upper limit is thus 4.0% by weight.

It is preferred from a standpoint of corrosion resistance to add at least 0.1% by weight.

(Ti, Nb, V, Zr, W, Ta, and B)

Titanium, niobium, vanadium, zirconium, tungsten, and tantalum are carbonitride-forming elements, and boron is a nitride-forming element. They are thus effective for restraining grain boundary precipitation of chromium carbonitride by thermal influence during welding and preventing nitridation by nitrogen picked up from the ambient gas during welding, thereby improving the toughness of welds. Also due to the synergistic effect of these elements combined with positive addition of P according to the invention, rust prevention of welds is significantly improved. As to the addition amount, the upper limit is 1.0% by weight for Ti, Nb, V, W, Zr, and Ta and 0.01% by weight for B. With respect to the preferred addition amounts for these elements to exert their effect, Ti, Nb, V, Zr, W, Ta, and B are added so that the respective elements as expressed in % by weight meet the following equation (I).

$$8\times(C+N)\leqq Ti+Nb+V+Zr+W+Ta+B\leqq 1 \quad \text{(I)}$$

(Cu, Ni and Co)

Copper, nickel, and cobalt are elements effective for increasing acid resistance and improving atmospheric corrosion resistance and rust prevention. If Cu is contained in excess of 1.0% by weight, hot ductility deteriorates, stress corrosion cracking susceptibility increases, and weld toughness deteriorates. The upper limit is thus 1.0% by weight. If Ni is contained in excess of 5.0% by weight, workability lowers, a $\gamma$-phase creates obstructing ferrite single phase steel and economy is lowered. The upper limit is thus 5.0% by weight. If Co is contained in excess of 1.0% by weight, workability lowers. The upper limit of Co is thus 1.0% by weight. In order that these elements be effective, preferably containment of at least 0.05% by weight is necessary.

It is understood that incidental impurities, O, Ca, Mg and the like are additionally present. For O, up to 0.01% by weight is preferred since workability and corrosion resistance lower in excess of 0.01% by weight. Ca and Mg are readily introduced from the furnace refractory in the steelmaking stage, used as mold flux during continuous casting, and effective for preventing nozzle clogging. Each of Ca and Mg should preferably be up to 0.002% by weight since more than 0.002% by weight of each element can cause a lowering of atmospheric corrosion resistance and rust prevention.

According to the present invention, high Cr content, P added ferritic stainless steel having improved atmospheric corrosion resistance and rust prevention is accomplished by adding a predetermined amount of P to the above-defined chemical composition.

The inventive steel finds a wide range of application as ferritic stainless steel used under conditions where atmospheric corrosion resistance and rust prevention are required, for example, building exterior materials and hot water boiler casings.

The inventive steel can be prepared by a conventional manufacturing process including the steps of melting-hot rolling-annealing-pickling-cold rolling-annealing-(pickling)-(skin pass rolling).

Moreover, the inventive steel is fully effective irrespective of its service form, either hot rolled annealed strips or cold rolled annealed strips (2D, 2B, BA, HL, and ground finish).

EXAMPLE

Examples of the present invention are given below by way of illustration.

EXAMPLE 1

Each 50-kg small steel ingot of the composition shown in Tables 1-1, 1-2 and 1-3 was melted in a vacuum high-frequency furnace, heated at 1,250° C. for one hour, hot rolled into a plate of 4 mm gage, and then annealed into a hot rolled annealed plate. The plate was subject to shot blasting, pickled to remove scales from the surface, cold rolled to a gage of 0.6 mm, and then reheated in a temperature range of 950° to 1,150° C. for 30 seconds, obtaining a cold rolled annealed plate. Specimens were obtained by polishing the stock plate with #500 emery paper. One specimen was subjected to an atmospheric exposure test (JIS Z-2381) at a distance of 5 m from the sea line. Another specimen was subjected to a CASS test (JIS D-0201) for 240 hours wherein the degree of rusting was evaluated in four ratings of A to D representing A: no rusting; B: a low degree of rusting; C: a medium degree of rusting; and D: a high degree of rusting.

The dissolving behavior in an active state found during anode polarization curve measurement was evaluated in terms of an active state peak current density from the anode polarization curve. The anode polarization curve measurement was by a dynamic potential method at 20 mV/min.

The detail of the test procedures is as defined in JIS. In the atmospheric exposure test for examining atmospheric corrosion resistance in an actual environment, 3 specimens of 15 cm×10 cm for each steel lot were rested on a test stand at a southbound inclination angle of 36° and exposed to weather for two years whereupon rusting was quantitatively evaluated.

Figure 2:
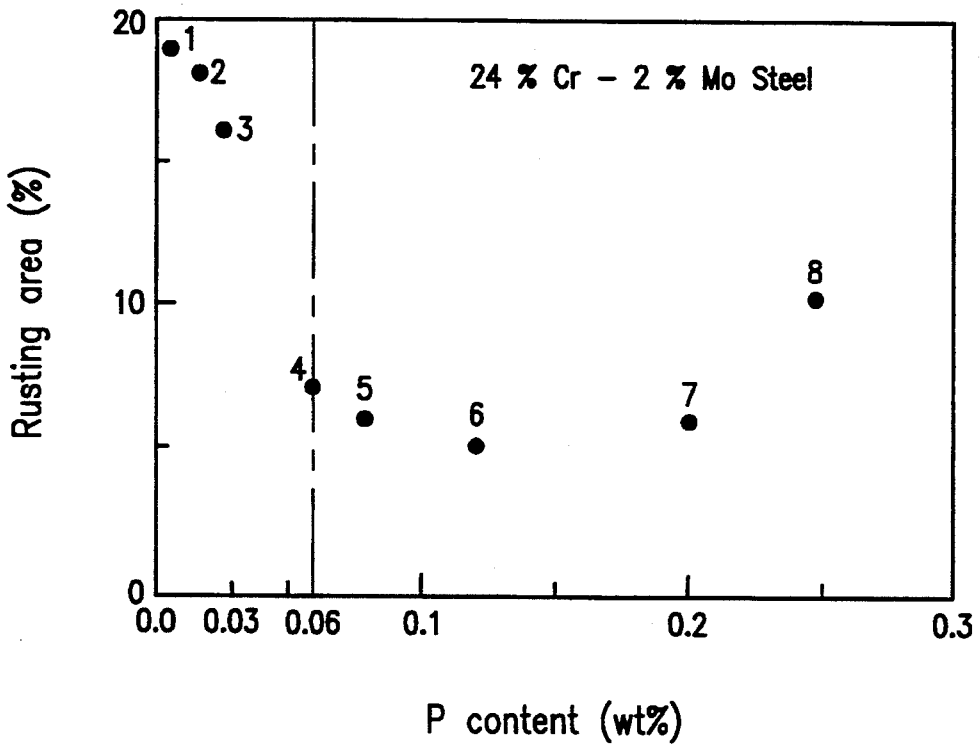
FIG. 2 is a diagram showing the influence on percent rusting area of P added to 24% Cr-2% Mo steel.

FIGS. 1 and 2 show the influence of phosphorus addition on the percent rusting area of 24 wt % Cr steel (Steel Nos. 1 to 7 in Table 1-1) and 24 wt % Cr-2 wt % Mo steel (Steel Nos. 1 to 8 in Table 1-2) after the atmospheric exposure test. It is to be noted that the percent rusting area used herein is the percent area of stains rather than that of red rust. Addition of P in excess of 0.06% by weight was effective for restraining red rust generation in the 24 wt % Cr steel and reducing the percent stain rusting area in the 24 wt % Cr-2 wt % Mo steel, indicating significant improvements in atmospheric corrosion resistance. With P added in excess of 0.2% by weight, however, atmospheric corrosion resistance rather starts lowering.

Figure 3:
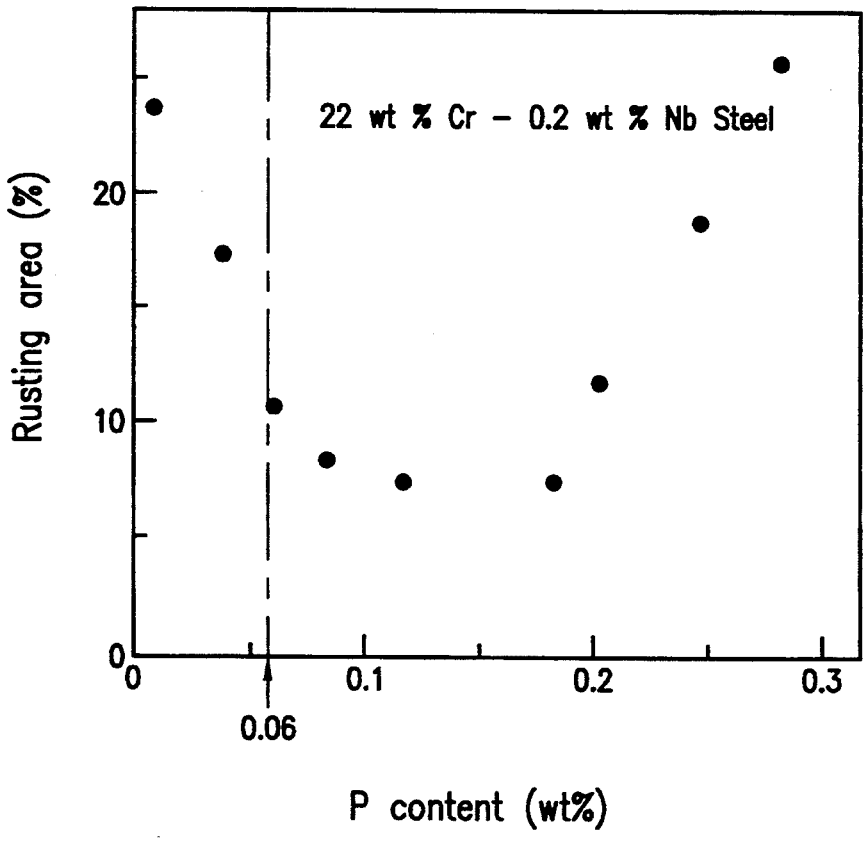
FIG. 3 is a diagram showing the influence of P on atmospheric corrosion resistance.
Figure 4:
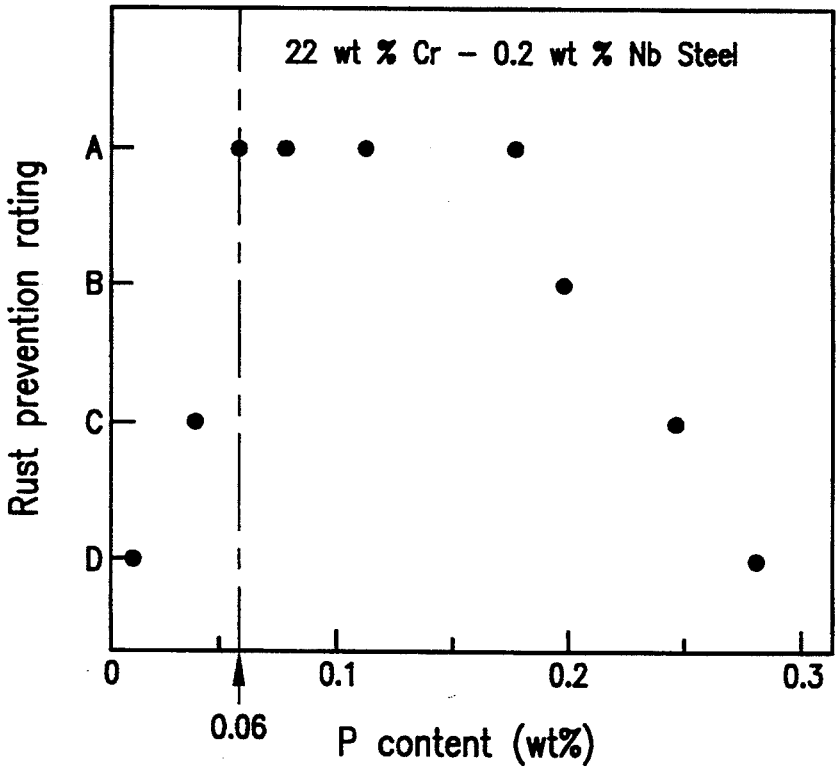
FIG. 4 is a diagram showing the influence of P on rust prevention.

Also, FIGS. 3 and 4 show the percent rusting area and rust prevention evaluation of 22 wt % Cr-0.2 wt % Nb steel. It is evident that addition of P in excess of 0.06% by weight leads to a significant improvement in atmospheric corrosion resistance. With P added in excess of 0.2% by weight, however, atmospheric corrosion resistance rather starts lowering.

Figure 5:
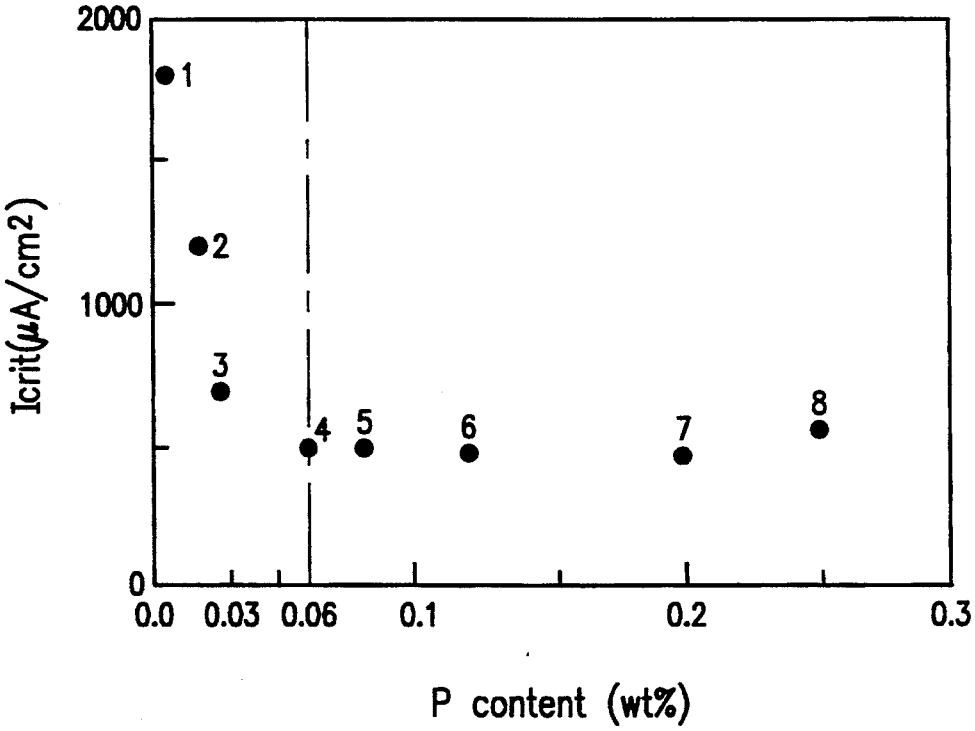
FIG. 5 is a diagram showing the influence on active state peak current density of P added to 24% Cr-2% Mo steel.

FIG. 5 shows the influence of P on the active state peak current density determined from the anode polarization curve measured on 24 wt % Cr-2 wt % Mo steel. It is also evident from these results that when P is added in amounts of from more than 0.06% by weight to 0.2% by weight, there is the region where the active state peak current density is the lowest. Note that the numbers in the figure represent Steel Nos. in Table 1-2.

The results of the 2-year atmospheric exposure test and the ratings of the 240-hour CASS test are shown in Table 2 (2-1-1, 2-1-2, and 2-2). Herein, the atmospheric exposure test evaluated whether or not red rust generated (O: no rust generated; X: red rust generated) and the CASS test was the same as evaluated in FIG. 4. The corrosion resistance of welds was evaluated by determining whether or not throughholes were formed after 1000-hour immersion and the toughness of welds was evaluated by a Charpy impact test (−20° C. and 0° C.,). The results are also shown in Table 2.

Note:

Atmospheric exposure test:

O: no red rust generated

X: red rust generated

Weld corrosion resistance:

Formation of throughholes after 1000-hour immersion

O: no

X: yes

Weld toughness:

O: ductile fracture surface

Δ: ductile/brittle fracture surface

X: brittle fracture surface

Figure 6:
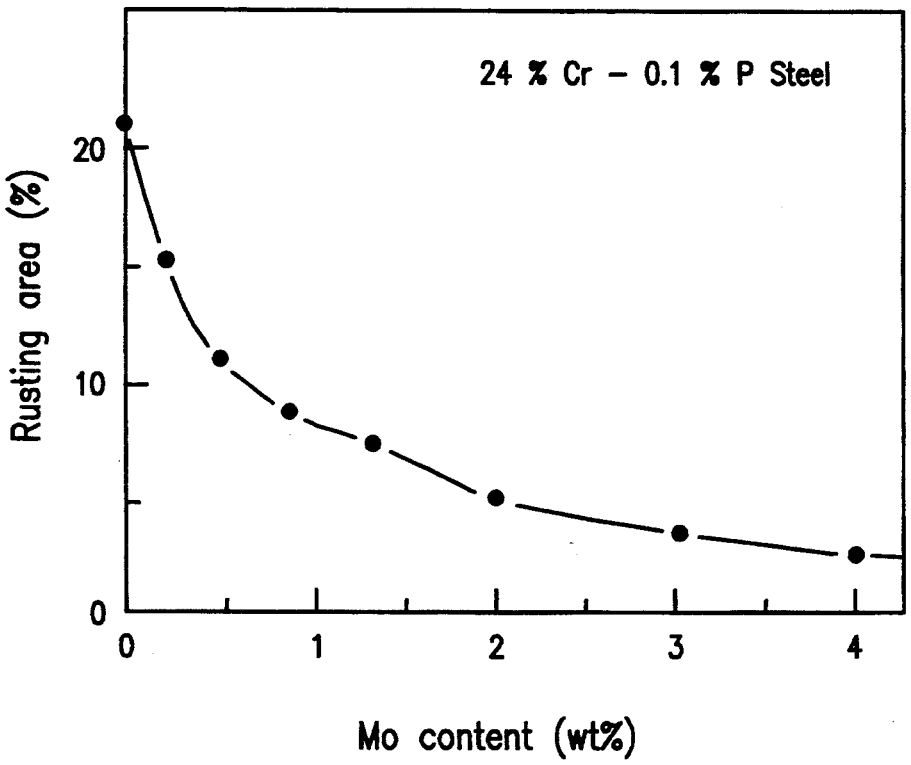
FIG. 6 is a diagram showing the influence on percent rusting area of Mo added to 24% Cr-0.1% P steel.

Similarly FIG. 6 shows the influence of molybdenum addition on the percent rusting area of 24 wt % Cr-0.1 wt % P steel after the atmospheric exposure test. It is seen that the percent rust area is decreased by molybdenum addition, specifically to about one-half of that prior to addition by adding 0.5% by weight of Mo.

Figure 7:
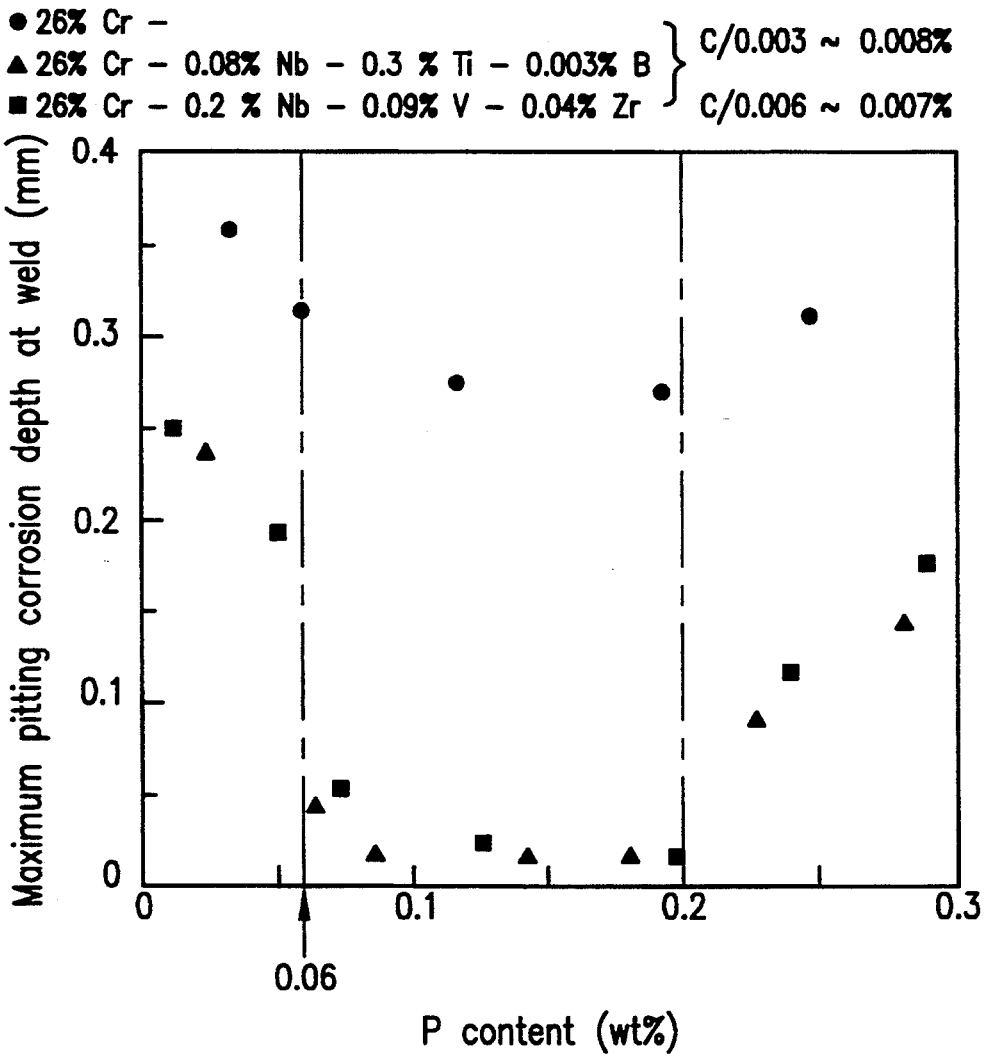
FIG. 7 is a diagram showing the influence of P on weld rust prevention.

Steel plates of 1.0 mm gage were prepared from 50-kg small steel ingots (vacuum high-frequency furnace melted) in which varying amounts of P, Nb, Ti, V, Zr, and B were added to 26 wt % Cr steel base (C: 0.003–0.008% by weight, N: 0.006–0.007% by weight, another component S within the scope of the invention) by hot rolling, annealing, shot blasting, pickling, cold rolling, and annealing. The steel plates on the surface were polished with #500 emery paper and butt welded by TIG welding technique. An immersion test was carried out by immersing the weld in an aqueous solution containing 1,160 ppm of $Cl^-$ and 800 ppm of $Cu^{++}$ (pH 3.5) at 80° C. for 10 days. The maximum pitting corrosion depth in the specimen is shown in FIG. 7. It is seen from FIG. 7 that by adding appropriate amounts of Nb, Ti, V, Zr, and B and adding from more than 0.06% by weight to 0.2% by weight of P, the rust prevention of the weld is significantly improved. That is, addition of P in combination with (Nb, Ti, V, Zr, W, Ta, and B) significantly improves the rust prevention at welds.

TABLE 1-1

| Steel No. | C | Si | Mn | P | S | Cr | Mo | Nb | Ti | Ni | Cu | N | Al | V,Zr,B Ta,W | Co | Remarks | Claim |
|---|---|---|---|---|---|---|---|---|---|---|---|---|---|---|---|---|---|
| | (wt %) | | | | | | | | | | | | | | | | |
| 1 | 0.006 | 0.18 | 0.13 | 0.012 | 0.003 | 23.95 | — | — | — | — | — | 0.0062 | 0.009 | — | — | Comparative Steel | — |
| 2 | 0.007 | 0.19 | 0.16 | 0.051 | 0.005 | 23.92 | — | — | — | — | — | 0.0035 | 0.017 | — | — | Comparative Steel | — |
| 3 | 0.011 | 0.18 | 0.15 | 0.062 | 0.002 | 24.09 | — | — | — | — | — | 0.0067 | 0.031 | — | — | Inventive Steel | Claim 1 |
| 4 | 0.009 | 0.17 | 0.14 | 0.102 | 0.004 | 23.87 | — | — | — | — | — | 0.0040 | 0.025 | — | — | Inventive Steel | Claim 1 |
| 5 | 0.006 | 0.19 | 0.17 | 0.168 | 0.008 | 23.96 | — | — | — | — | — | 0.0029 | 0.006 | — | — | Inventive Steel | Claim 1 |
| 6 | 0.008 | 0.18 | 0.16 | 0.231 | 0.007 | 24.10 | — | — | — | — | — | 0.0058 | 0.049 | — | — | Comparative Steel | — |
| 7 | 0.003 | 0.19 | 0.19 | 0.251 | 0.010 | 24.03 | — | — | — | — | — | 0.0109 | 0.037 | — | — | Comparative Steel | — |
| 8 | 0.007 | 0.62 | 0.22 | 0.084 | 0.006 | 20.71 | — | — | — | — | — | 0.0070 | 0.005 | — | — | Inventive Steel | Claim 1 |
| 9 | 0.005 | 0.38 | 0.15 | 0.120 | 0.002 | 27.05 | — | — | — | — | — | 0.0045 | 0.012 | — | — | Inventive Steel | Claim 1 |
| 10 | 0.013 | 0.17 | 0.78 | 0.068 | 0.003 | 28.11 | — | — | — | — | — | 0.0060 | 0.007 | — | — | Comparative Steel | — |
| 11 | 0.022 | 0.20 | 0.10 | 0.084 | 0.002 | 38.15 | — | — | — | — | — | 0.0047 | 0.012 | — | — | Comparative Steel | — |
| 12 | 0.008 | 0.57 | 0.30 | 0.086 | 0.007 | 22.76 | 0.59 | — | — | — | — | 0.0066 | 0.032 | — | — | Inventive Steel | Claim 2 |
| 13 | 0.005 | 0.08 | 0.04 | 0.103 | 0.005 | 26.48 | 3.14 | — | — | — | — | 0.0057 | 0.008 | — | — | Inventive Steel | Claim 2 |
| 14 | 0.014 | 0.20 | 0.16 | 0.097 | 0.004 | 24.16 | — | 0.12 | — | — | — | 0.0043 | 0.016 | — | — | Inventive Steel | Claim 3 |
| 15 | 0.007 | 0.31 | 0.24 | 0.077 | 0.009 | 20.61 | — | — | 0.07 | — | — | 0.0058 | 0.020 | — | — | Inventive Steel | Claim 3 |
| 16 | 0.012 | 0.16 | 0.20 | 0.081 | 0.003 | 29.05 | — | — | — | 0.16 | — | 0.0033 | 0.002 | — | — | Inventive Steel | Claim 5 |
| 17 | 0.004 | 0.26 | 0.15 | 0.132 | 0.010 | 27.45 | — | — | — | 0.02 | 0.14 | 0.0049 | 0.008 | — | — | Inventive Steel | Claim 5 |
| 18 | 0.007 | 0.56 | 0.20 | 0.073 | 0.008 | 30.85 | — | — | — | — | 0.68 | 0.0112 | 0.056 | — | — | Inventive Steel | Claim 5 |
| 19 | 0.005 | 0.16 | 0.13 | 0.088 | 0.005 | 32.51 | 0.93 | — | — | — | 0.82 | 0.0042 | 0.022 | — | — | Inventive Steel | Claim 8 |
| 20 | 0.011 | 0.30 | 0.21 | 0.235 | 0.006 | 24.50 | 0.61 | — | — | 0.58 | — | 0.0067 | 0.010 | — | — | Comparative Steel | — |
| 21 | 0.006 | 0.28 | 0.30 | 0.097 | 0.007 | 22.11 | 0.63 | 0.21 | 0.11 | — | — | 0.0061 | 0.033 | — | — | Inventive Steel | Claim 6 |
| 22 | 0.008 | 0.41 | 0.15 | 0.081 | 0.005 | 22.30 | 0.70 | — | 0.20 | — | — | 0.0051 | 0.007 | — | — | Inventive Steel | Claim 6 |
| 23 | 0.005 | 0.18 | 0.13 | 0.088 | 0.006 | 20.21 | 0.68 | 0.33 | — | — | — | 0.0042 | 0.022 | — | — | Inventive Steel | Claim 6 |

"—" indicates trace.

TABLE 1-2

| Steel No. | C | Si | Mn | P | S | Cr | Mo | Cu | Nb | Ti | N | Ni | Al | V,Zr,B Ta,W | Co | Remarks | Claim |
|---|---|---|---|---|---|---|---|---|---|---|---|---|---|---|---|---|---|
| | (wt %) | | | | | | | | | | | | | | | | |
| 1 | 0.004 | 0.24 | 0.13 | 0.012 | 0.003 | 24.02 | 1.98 | 0.01 | 0.38 | 0.005 | 0.0041 | 0.02 | 0.012 | — | — | Comparative Steel | — |
| 2 | 0.003 | 0.2 | 0.12 | 0.020 | 0.003 | 24.1 | 1.99 | 0.02 | 0.41 | 0.004 | 0.0035 | 0.02 | 0.011 | — | — | Comparative Steel | — |
| 3 | 0.004 | 0.24 | 0.12 | 0.031 | 0.003 | 24.11 | 2.06 | 0.01 | 0.38 | 0.004 | 0.0034 | 0.01 | 0.010 | — | — | Comparative Steel | — |

TABLE 1-2-continued

| Steel No. | C | Si | Mn | P | S | Cr | Mo | Cu | Nb | Ti | N | Ni | Al | V,Zr,B Ta,W | Co | Remarks | Claim |
|---|---|---|---|---|---|---|---|---|---|---|---|---|---|---|---|---|---|
| | (wt %) | | | | | | | | | | | | | | | | |
| 4 | 0.004 | 0.23 | 0.11 | 0.063 | 0.003 | 24.12 | 1.89 | 0.01 | 0.38 | 0.004 | 0.0042 | 0.02 | 0.012 | — | — | Inventive Steel | Claim 6 |
| 5 | 0.003 | 0.21 | 0.13 | 0.082 | 0.002 | 24.06 | 2 | 0.02 | 0.39 | 0.005 | 0.0038 | 0.01 | 0.013 | — | — | Inventive Steel | Claim 6 |
| 6 | 0.003 | 0.22 | 0.11 | 0.121 | 0.003 | 24.2 | 1.95 | 0.01 | 0.42 | 0.004 | 0.0041 | 0.02 | 0.010 | — | — | Inventive Steel | Claim 6 |
| 7 | 0.004 | 0.21 | 0.09 | 0.20 | 0.003 | 24.18 | 2.18 | 0.01 | 0.4 | 0.004 | 0.0042 | 0.01 | 0.012 | — | — | Inventive Steel | Claim 6 |
| 8 | 0.004 | 0.25 | 0.13 | 0.25 | 0.003 | 24.06 | 2.01 | 0.02 | 0.41 | 0.004 | 0.0038 | 0.01 | 0.010 | — | — | Comparative Steel | — |
| 9 | 0.013 | 0.24 | 0.13 | 0.067 | 0.002 | 24.1 | 2 | 0.01 | 0.39 | 0.003 | 0.0041 | 0.01 | 0.012 | — | — | Inventive Steel | Claim 6 |
| 10 | 0.021 | 0.21 | 0.12 | 0.068 | 0.003 | 24.18 | 1.88 | 0.02 | 0.35 | 0.002 | 0.0035 | 0.02 | 0.012 | — | — | Comparative Steel | — |
| 11 | 0.003 | 0.19 | 0.21 | 0.066 | 0.004 | 19.98 | 1.88 | 0.01 | 0.38 | 0.002 | 0.0036 | 0.03 | 0.011 | — | — | Comparative Steel | — |
| 12 | 0.005 | 0.2 | 0.63 | 0.066 | 0.004 | 24.06 | 1.69 | 0.01 | 0.41 | 0.002 | 0.0035 | 0.02 | 0.012 | — | — | Comparative Steel | — |
| 13 | 0.003 | 0.2 | 0.1 | 0.067 | 0.01 | 23 | 2.05 | 0.02 | 0.38 | 0.20 | 0.0031 | 0.01 | 0.013 | — | — | Inventive Steel | Claim 6 |
| 14 | 0.003 | 0.18 | 0.12 | 0.075 | 0.04 | 23.5 | 1.99 | 0.01 | 0.41 | 0.002 | 0.0032 | 0.02 | 0.013 | — | — | Comparative Steel | — |
| 15 | 0.004 | 0.21 | 0.09 | 0.063 | 0.003 | 12.03 | 1.88 | 0.01 | 0.38 | 0.002 | 0.0031 | 0.02 | 0.015 | — | — | Comparative Steel | — |
| 16 | 0.003 | 0.22 | 0.11 | 0.072 | 0.003 | 17.21 | 1.95 | 0.01 | 0.41 | 0.003 | 0.0029 | 0.02 | 0.21 | — | — | Comparative Steel | — |
| 17 | 0.003 | 0.19 | 0.11 | 0.067 | 0.004 | 30.02 | 2.02 | 0.01 | 0.44 | 0.002 | 0.0028 | 0.01 | 0.016 | — | — | Inventive Steel | Claim 6 |
| 18 | 0.003 | 0.2 | 0.12 | 0.063 | 0.003 | 34.1 | 2 | 0.01 | 0.4 | 0.002 | 0.0034 | 0.02 | 0.011 | — | — | Inventive Steel | Claim 6 |
| 19 | 0.003 | 0.23 | 0.13 | 0.066 | 0.003 | 25 | 3.89 | 0.01 | 0.42 | 0.003 | 0.0029 | 0.02 | 0.013 | — | — | Inventive Steel | Claim 6 |
| 20 | 0.003 | 0.18 | 0.09 | 0.064 | 0.003 | 24.01 | 5 | 0.01 | 0.39 | 0.002 | 0.0029 | 0.02 | 0.015 | — | — | Comparative Steel | — |
| 21 | 0.002 | 0.21 | 0.09 | 0.079 | 0.004 | 24.39 | 1.93 | 1.0 | 0.38 | 0.002 | 0.0031 | 0.01 | 0.011 | — | — | Inventive Steel | Claim 9 |
| 22 | 0.001 | 0.22 | 0.09 | 0.062 | 0.003 | 24.1 | 1.88 | 0.02 | 0.1 | 0.002 | 0.0018 | 0.02 | 0.013 | — | — | Inventive Steel | Claim 6 |
| 23 | 0.003 | 0.3 | 0.11 | 0.066 | 0.004 | 23.96 | 1.81 | 0.01 | 0.6 | 0.003 | 0.0031 | 0.02 | 0.014 | — | — | Inventive Steel | Claim 6 |
| 24 | 0.004 | 0.15 | 0.1 | 0.052 | 0.003 | 23.33 | 2.15 | 0.01 | 0.01 | 0.01 | 0.0032 | 0.02 | 0.015 | — | — | Comparative Steel | — |
| 25 | 0.003 | 0.2 | 0.12 | 0.064 | 0.003 | 24.05 | 2.09 | 0.01 | 0.01 | 0.1 | 0.0029 | 0.01 | 0.011 | — | — | Inventive Steel | Claim 6 |
| 26 | 0.003 | 0.24 | 0.11 | 0.067 | 0.004 | 24.06 | 2.04 | 0.01 | 0.01 | 0.3 | 0.0028 | 0.01 | 0.012 | — | — | Inventive Steel | Claim 6 |
| 27 | 0.003 | 0.21 | 0.1 | 0.063 | 0.004 | 22.58 | 1.96 | 0.01 | 0.4 | 0.1 | 0.003 | 0.02 | 0.015 | — | — | Inventive Steel | Claim 6 |
| 28 | 0.003 | 0.21 | 0.1 | 0.066 | 0.003 | 23.18 | 1.99 | 0.01 | 0.41 | 0.004 | 0.015 | 0.02 | 0.011 | — | — | Inventive Steel | Claim 6 |
| 29 | 0.003 | 0.23 | 0.11 | 0.068 | 0.004 | 24.86 | 2.38 | 0.02 | 0.42 | 0.002 | 0.3 | 0.01 | 0.011 | — | — | Comparative Steel | — |
| 30 | 0.003 | 0.22 | 0.13 | 0.065 | 0.004 | 24.71 | 2.1 | 0.02 | 0.39 | 0.002 | 0.0038 | 1.0 | 0.014 | — | — | Inventive Steel | Claim 11 |
| 31 | 0.004 | 0.21 | 0.09 | 0.062 | 0.003 | 24.35 | 2 | 0.02 | 0.41 | 0.002 | 0.0028 | 0.002 | 0.1 | — | — | Inventive Steel | Claim 6 |

TABLE 1-3

| Steel No. | C | Si | Mn | P | S | Cr | Mo | Nb | Ti | V | Remarks | Claim |
|---|---|---|---|---|---|---|---|---|---|---|---|---|
| 1 | 0.007 | 0.47 | 0.16 | 0.026 | 0.003 | 23.45 | — | 0.14 | — | 0.002 | Comparative Example | — |
| 2 | 0.010 | 0.74 | 0.33 | 0.245 | 0.002 | 24.12 | — | — | 0.27 | — | Comparative Example | — |
| 3 | 0.008 | 0.27 | 0.08 | 0.073 | 0.004 | 42.36 | — | — | 0.30 | 0.06 | Comparative Example | — |
| 4 | 0.007 | 0.45 | 0.39 | 0.095 | 0.007 | 30.08 | — | — | — | — | Comparative Example | — |
| 5 | 0.023 | 0.16 | 0.28 | 0.124 | 0.005 | 20.86 | — | 0.27 | — | 0.06 | Comparative Example | — |
| 6 | 0.010 | 0.84 | 0.21 | 0.070 | 0.003 | 24.65 | — | 0.42 | — | — | Inventive Example | Claim 3 |
| 7 | 0.004 | 0.08 | 0.51 | 0.182 | 0.002 | 29.16 | — | — | 0.30 | — | Inventive Example | Claim 3 |
| 8 | 0.002 | 0.37 | 0.26 | 0.104 | 0.009 | 32.06 | — | — | — | 0.02 | Inventive Example | Claim 3 |
| 9 | 0.006 | 0.40 | 0.31 | 0.064 | 0.002 | 20.79 | — | 0.01 | — | — | Inventive Example | Claim 3 |
| 10 | 0.005 | 0.07 | 0.22 | 0.088 | 0.002 | 24.56 | 4.27 | 0.20 | — | — | Comparative Example | — |
| 11 | 0.004 | 0.32 | 0.18 | 0.075 | 0.002 | 22.65 | 0.07 | — | 0.23 | — | Comparative Example | — |
| 12 | 0.010 | 0.25 | 0.30 | 0.084 | 0.012 | 20.95 | 0.09 | — | — | 0.30 | Inventive Example | Claim 11 |
| 13 | 0.006 | 0.18 | 0.27 | 0.067 | 0.005 | 33.54 | 1.08 | 0.16 | — | — | Inventive Example | Claim 6 |
| 14 | 0.004 | 0.23 | 0.80 | 0.095 | 0.002 | 21.56 | 0.03 | — | 0.16 | — | Inventive Example | Claim 6 |
| 15 | 0.018 | 0.45 | 0.22 | 0.101 | 0.003 | 28.40 | 3.26 | — | — | 0.50 | Inventive Example | Claim 6 |
| 16 | 0.005 | 0.50 | 0.32 | 0.065 | 0.002 | 24.13 | 0.02 | — | 0.20 | — | Inventive Example | Claim 11 |
| 17 | 0.003 | 0.16 | 0.22 | 0.184 | 0.006 | 21.50 | 1.44 | 0.40 | — | — | Inventive Example | Claim 11 |

TABLE 1-3-continued

| | | | | | | | | | | | | |
|---|---|---|---|---|---|---|---|---|---|---|---|---|
| 18 | 0.007 | 0.28 | 0.09 | 0.077 | 0.004 | 30.14 | 0.05 | 0.15 | — | — | Inventive Example | Claim 11 |
| 19 | 0.004 | 0.61 | 0.50 | 0.070 | 0.003 | 26.51 | 0.02 | — | 0.33 | — | Inventive Example | Claim 11 |
| 20 | 0.005 | 0.27 | 0.33 | 0.088 | 0.010 | 24.22 | 0.01 | — | — | 0.13 | Inventive Example | Claim 11 |

| Steel No. | Zr | Ta | W | B | Cu | Co | Ni | Al | N | Remarks |
|---|---|---|---|---|---|---|---|---|---|---|
| 1 | — | — | — | 0.0010 | — | — | — | 0.13 | 0.009 | Comparative Example |
| 2 | — | 0.10 | — | — | — | — | — | 0.006 | 0.003 | Comparative Example |
| 3 | — | — | — | — | — | — | — | 0.016 | 0.004 | Comparative Example |
| 4 | 0.010 | — | — | — | — | — | — | 0.009 | 0.005 | Comparative Example |
| 5 | — | — | — | 0.0031 | — | — | — | 0.068 | 0.017 | Comparative Example |
| 6 | — | — | — | — | — | — | — | 0.143 | 0.007 | Inventive Example |
| 7 | — | 0.07 | — | — | — | — | — | 0.010 | 0.008 | Inventive Example |
| 8 | 0.19 | — | — | 0.002 | — | — | — | 0.066 | 0.003 | Inventive Example |
| 9 | — | — | 0.10 | — | — | — | — | 0.103 | 0.001 | Inventive Example |
| 10 | 0.01 | — | — | — | — | — | — | 0.055 | 0.003 | Comparative Example |
| 11 | — | — | — | — | 1.61 | — | 0.01 | 0.033 | 0.006 | Comparative Example |
| 12 | — | — | — | — | 0.03 | — | 0.12 | 0.049 | 0.007 | Inventive Example |
| 13 | — | 0.03 | — | 0.002 | — | — | — | 0.276 | 0.002 | Inventive Example |
| 14 | 0.02 | — | — | — | — | — | — | 0.032 | 0.005 | Inventive Example |
| 15 | — | — | — | — | — | — | — | 0.185 | 0.012 | Inventive Example |
| 16 | — | — | 0.07 | — | 0.06 | — | — | 0.005 | 0.004 | Inventive Example |
| 17 | — | — | — | — | — | 0.12 | — | 0.033 | 0.005 | Inventive Example |
| 18 | — | 0.03 | — | 0.001 | — | — | 0.10 | 0.044 | 0.003 | Inventive Example |
| 19 | — | — | — | — | — | — | 1.95 | 0.295 | 0.005 | Inventive Example |
| 20 | — | 0.22 | — | — | 0.66 | — | — | 0.071 | 0.007 | Inventive Example |

TABLE 2-1-1

| Steel No. | Atmospheric exposure test | CASS | Weld corrosion resistance | Weld toughness −20° C. | Weld toughness 0° C. |
|---|---|---|---|---|---|
| 1 | X | C | X | ○ | Δ |
| 2 | ○ | B | ○ | ○ | Δ |
| 3 | ○ | A | ○ | ○ | Δ |
| 4 | ○ | A | ○ | ○ | Δ |
| 5 | ○ | A | ○ | ○ | Δ |
| 6 | X | B | X | ○ | X |
| 7 | X | B | X | ○ | X |
| 8 | ○ | A | ○ | ○ | Δ |
| 9 | ○ | A | ○ | ○ | Δ |
| 10 | X | B | X | Δ | X |
| 11 | X | C | X | X | X |
| 12 | ○ | A | ○ | ○ | Δ |
| 13 | ○ | A | ○ | ○ | X |
| 14 | ○ | A | ○ | ○ | ○ |
| 15 | ○ | A | ○ | ○ | ○ |
| 16 | ○ | A | ○ | ○ | ○ |
| 17 | ○ | A | ○ | ○ | ○ |
| 18 | ○ | A | ○ | ○ | ○ |
| 19 | ○ | A | ○ | ○ | ○ |
| 20 | X | C | X | ○ | Δ |
| 21 | ○ | A | ○ | ○ | ○ |
| 22 | ○ | A | ○ | ○ | ○ |
| 23 | ○ | A | ○ | ○ | ○ |

TABLE 2-1-2

| Steel No. | Atmospheric exposure test | CASS | Weld corrosion resistance | Weld toughness −20° C. | Weld toughness 0° C. |
|---|---|---|---|---|---|
| 1 | X | B | X | ○ | ○ |
| 2 | X | B | X | ○ | ○ |
| 3 | X | B | X | ○ | ○ |
| 4 | ○ | A | ○ | ○ | ○ |
| 5 | ○ | A | ○ | ○ | ○ |
| 6 | ○ | A | ○ | ○ | ○ |
| 7 | ○ | A | ○ | ○ | ○ |
| 8 | X | B | ○ | ○ | Δ |
| 9 | ○ | A | ○ | ○ | ○ |
| 10 | X | C | X | ○ | X |
| 11 | X | B | X | ○ | ○ |
| 12 | X | B | X | Δ | X |
| 13 | ○ | A | ○ | ○ | ○ |
| 14 | X | C | X | ○ | Δ |
| 15 | X | D | X | ○ | ○ |
| 16 | X | C | X | ○ | ○ |
| 17 | ○ | A | ○ | ○ | ○ |
| 18 | ○ | A | ○ | ○ | ○ |
| 19 | ○ | A | ○ | ○ | ○ |

TABLE 2-1-2-continued

| Steel No. | Atmospheric exposure test | CASS | Weld corrosion resistance | Weld toughness −20° C. | Weld toughness 0° C. |
|---|---|---|---|---|---|
| 20 | ○ | A | ○ | X | X |
| 21 | ○ | A | ○ | ○ | ○ |
| 22 | ○ | A | ○ | ○ | Δ |
| 23 | ○ | A | ○ | ○ | ○ |
| 24 | X | B | X | ○ | X |
| 25 | ○ | A | ○ | ○ | ○ |
| 26 | ○ | A | ○ | ○ | ○ |
| 27 | ○ | A | ○ | ○ | ○ |
| 28 | ○ | A | ○ | ○ | ○ |
| 29 | X | C | X | X | X |
| 30 | ○ | A | ○ | ○ | ○ |
| 31 | ○ | A | ○ | ○ | ○ |

TABLE 2-2

| Steel No. | Atmospheric exposure test | CASS | Weld corrosion resistance | Weld toughness −20° C. | Weld toughness 0° C. |
|---|---|---|---|---|---|
| 1 | X | C | X | ○ | ○ |
| 2 | X | C | X | ○ | X |
| 3 | ○ | A | ○ | ○ | X |
| 4 | ○ | A | X | X | X |
| 5 | ○ | A | X | X | X |
| 6 | ○ | A | ○ | ○ | ○ |
| 7 | ○ | A | ○ | ○ | ○ |
| 8 | ○ | A | ○ | ○ | ○ |
| 9 | ○ | A | ○ | ○ | ○ |
| 10 | ○ | A | ○ | ○ | X |
| 11 | ○ | A | ○ | X | X |
| 12 | ○ | A | ○ | ○ | ○ |
| 13 | ○ | A | ○ | ○ | ○ |
| 14 | ○ | A | ○ | ○ | ○ |
| 15 | ○ | A | ○ | ○ | ○ |
| 16 | ○ | A | ○ | ○ | ○ |
| 17 | ○ | A | ○ | ○ | ○ |
| 18 | ○ | A | ○ | ○ | ○ |
| 19 | ○ | A | ○ | ○ | ○ |
| 20 | ○ | A | ○ | ○ | ○ |

INDUSTRIAL APPLICABILITY

With the present invention constructed as defined above, the ferritic stainless steel of the specific composition melt prepared according to the present invention has benefits including improved weathering resistance, rust prevention and weld properties as well as low cost manufacture and is thus useful in the industry.

We claim:

1. A high Cr content, P added ferritic stainless building material steel having improved atmospheric corrosion resistance and rust prevention, containing, in % by weight, C: up to 0.02%,
Si: up to 1.0%,
Mn: less than 1.0%,
S: up to 0.03%,
Cr: from more than 20% to 40%,
N: up to 0.015%,
Al: up to 0.5%, and
P: from more than 0.06% to 0.20%, the balance being Fe and incidental impurities.

2. A high Cr content, P added ferritic stainless building material steel having improved atmospheric corrosion resistance and rust prevention as set forth in claim 1, which further contains up to 4.0% of Mo.

3. A high Cr content, P added ferritic stainless building material steel having improved atmospheric corrosion resistance and rust prevention as set forth in claim 1, which further contains one or more elements of up to 1.0% of Ti, up to 1.0% of Nb, up to 1.0% of Ta, up to 1.0% of V, up to 1.0% of W, up to 1.0% of Zr, and up to 0.01% of B.

4. A high Cr content, P added ferritic stainless building material steel having improved atmospheric corrosion resistance and rust prevention as set forth in claim 3 wherein the respective elements as expressed in % by weight meet the following equation (I).

$$8\times(C+N)\leqq Ti+Nb+V+Zr+W+Ta+B\leqq 1 \quad (I)$$

5. A high Cr content, P added ferritic stainless building material steel having improved atmospheric corrosion resistance and rust prevention as set forth in claim 1, which further contains one or more elements of up to 1.0% of Cu, up to 5.0% of Ni, and up to 1.0% of Co.

6. A high Cr content, P added ferritic stainless building material steel having improved atmospheric corrosion resistance and rust prevention as set forth in claim 1, which further contains up to 4.0% of Mo, and
one or more elements of up to 1.0% of Ti, up to 1.0% of Nb, up to 1.0% of Ta, up to 1.0% of V, up to 1.0% of W, up to 1.0% of Zr, and up to 0.01% of B.

7. A high Cr content, P added ferritic stainless building material steel having improved atmospheric corrosion resistance and rust prevention as set forth in claim 6 wherein the respective elements as expressed in % by weight meet the following equation (I).

$$8\times(C+N)\leqq Ti+Nb+V+Zr+W+Ta+B\leqq 1 \quad (I)$$

8. A high Cr content, P added ferritic stainless building material steel having improved atmospheric corrosion resistance and rust prevention as set forth in claim 1, which further contains up to 4.0% of Mo, and
one or more elements of up to 1.0% of Cu, up to 5.0% of Ni, and up to 1.0% of Co.

9. A high Cr content, P added ferritic stainless building material steel having improved atmospheric corrosion resistance and rust prevention as set forth in claim 1, which further contains one or more elements of up to 1.0% of Ti, up to 1.0% of Nb, up to 1.0% of Ta, up to 1.0% of V, up to 1.0% of W, up to 1.0% of Zr, and up to 0.01% of B, and
one or more elements of up to 1.0% of Cu, up to 5.0% of Ni, and up to 1.0% of Co.

10. A high Cr content, P added ferritic stainless building material steel having improved atmospheric corrosion resistance and rust prevention as set forth in claim 9 wherein the respective elements as expressed in % by weight meet the following equation (I).

$$8\times(C+N)\leqq Ti+Nb+V+Zr+W+Ta+B\leqq 1 \quad (I)$$

11. A high Cr content, P added ferritic stainless building material steel having improved atmospheric corrosion resistance and rust prevention as set forth in claim 1, which further contains up to 4.0% of Mo,
one or more elements of up to 1.0% of Ti, up to 1.0% of Nb, up to 1.0% of Ta, up to 1.0% of V, up to 1.0% of W, up to 1.0% of Zr, and up to 0.01% of B, and
one or more elements of up to 1.0% of Cu, up to 5.0% of Ni, and up to 1.0% of Co.

12. A high Cr content, P added ferritic stainless building material steel having improved atmospheric corrosion resistance and rust prevention as set forth in claim 11 wherein the respective elements as expressed in % by weight meet the following equation (I).

$$8\times(C+N)\leqq Ti+Nb+V+Zr+W+Ta+B\leqq 1 \quad (I)$$

13. A high Cr content, P added ferritic stainless building material steel having improved atmospheric corrosion resistance and rust prevention, containing, in % by weight, C: up to 0.02%,
Si: up to 1.0%,
Mn: up to 1.0%,
S: up to 0.03%,
Cr: from more than 20% to 40%,
N: up to 0.015%,
Al: 0.005 to 0.5%, and
P: from more than 0.06% to 0.20%, the balance being Fe and incidental impurities.

14. A high Cr content, P added ferritic stainless building material steel having improved atmospheric corrosion resistance and rust prevention as set forth in claim 13, which further contains up to 4.0% of Mo.

15. A high Cr content, P added ferritic stainless building material steel having improved atmospheric corrosion resistance and rust prevention as set forth in claim 13, which further contains one or more elements of up to 1.0% of Ti, up to 1.0% of Nb, up to 1.0% of Ta, up to 1.0% of V, up to 1.0% of W, up to 1.0% of Zr, and up to 0.01% of B.

16. A high Cr content, P added ferritic stainless building material steel having improved atmospheric corrosion resistance and rust prevention as set forth in claim 15 wherein the respective elements as expressed in % by weight meet the following equation (I).

$$8\times(C+N)\leqq Ti+Nb+V+Zr+W+Ta+B\leqq 1 \quad (I)$$

17. A high Cr content, P added ferritic stainless building material steel having improved atmospheric corrosion resistance and rust prevention as set forth in claim 13, which further contains one or more elements of up to 1.0% of Cu, up to 5.0% of Ni, and up to 1.0% of Co.

* * * * *